US008317019B2

(12) United States Patent
Cruce et al.

(10) Patent No.: US 8,317,019 B2
(45) Date of Patent: Nov. 27, 2012

(54) GOLF BALL PICKER BASKET AND METHOD

(75) Inventors: Christopher J. Cruce, Poway, CA (US); James Graham, Santa Paula, CA (US)

(73) Assignee: Christopher J. Cruce, Poway, CA (US)

( * ) Notice: Subject to any disclaimer, the term of this patent is extended or adjusted under 35 U.S.C. 154(b) by 198 days.

(21) Appl. No.: 12/544,086

(22) Filed: Aug. 19, 2009

(65) Prior Publication Data

US 2011/0042250 A1 Feb. 24, 2011

(51) Int. Cl.
*B65D 85/00* (2006.01)
*B65D 6/40* (2006.01)
*B65D 25/54* (2006.01)

(52) U.S. Cl. ..... 206/315.9; 220/661; 220/676

(58) Field of Classification Search ..... 206/509–511, 206/315.9, 504; 220/509, 516, 661, 676, 220/23.2; D9/424, 425
See application file for complete search history.

(56) References Cited

U.S. PATENT DOCUMENTS

| | | | | | |
|---|---|---|---|---|---|
| 3,053,397 | A | * | 9/1962 | Bliss | 211/126.2 |
| 3,379,339 | A | * | 4/1968 | Asenbauer | 206/506 |
| 3,534,866 | A | * | 10/1970 | Asenbauer | 211/126.2 |
| 4,247,004 | A | * | 1/1981 | Bird | 206/506 |
| 4,759,451 | A | * | 7/1988 | Apps | 211/126.4 |
| D304,638 | S | * | 11/1989 | Ireland | D3/304 |
| 5,071,008 | A | * | 12/1991 | Hradisky | 206/507 |
| 5,129,526 | A | * | 7/1992 | Craft et al. | 206/449 |
| D336,698 | S | * | 6/1993 | Conaway et al. | D3/307 |
| 5,480,078 | A | * | 1/1996 | Verrette et al. | 224/274 |
| D375,836 | S | * | 11/1996 | Conti | D3/304 |
| 5,660,784 | A | * | 8/1997 | Cruce et al. | 264/328.1 |
| D389,621 | S | * | 1/1998 | Short et al. | D32/37 |
| D395,392 | S | * | 6/1998 | Lahm et al. | D9/425 |
| D408,603 | S | * | 4/1999 | Haley | D32/55 |
| 5,951,134 | A | * | 9/1999 | Braun et al. | 312/405.1 |
| 7,462,010 | B1 | * | 12/2008 | Wittek et al. | 414/440 |
| 2005/0189360 | A1 | * | 9/2005 | Loucks et al. | 220/676 |

(Continued)

OTHER PUBLICATIONS

Range Sweep—Golf Ball Picker, [online], [retrieved on Mar. 1, 2011]. Retrieved from Eastern Golf Corporation website. <URL: http://www.easterngolf.com/range1.htm>.

(Continued)

*Primary Examiner* — Mickey Yu
*Assistant Examiner* — Kaushikkumar Desai
(74) *Attorney, Agent, or Firm* — Bernard L. Kleinke; Duckor Spradling Metzger & Wynne

(57) ABSTRACT

There is disclosed a method and a basket for use with a golf ball range picker having a support frame. The basket may include a pair of inwardly offset handles in the basket side walls for ease of lifting when a series of two or more like baskets are arranged in a closely spaced side by side configuration. A pair of front edges of front side wall sections are each tapered outwardly toward the front to minimize or at least greatly reduce the surface area formed by abutting vertical edges with a like basket, to help guide the golf balls being thrown by the range picker into the baskets, and not deflect them inadvertently away from entering the baskets by otherwise providing thick abutting vertical edges which could block the path of travel of the golf balls. A front flange is disposed substantially along the entire length of the front of the basket for resting securely on a front portion of the support frame, and a rear flange is adapted for resting securely on a back portion of the support frame.

14 Claims, 11 Drawing Sheets

U.S. PATENT DOCUMENTS

| | | | | |
|---|---|---|---|---|
| 2006/0103087 | A1* | 5/2006 | Alcala Sebastian | 280/47.26 |
| 2007/0235963 | A1* | 10/2007 | Killinger et al. | 280/47.26 |
| 2008/0121253 | A1* | 5/2008 | Shotwell | 134/25.4 |

OTHER PUBLICATIONS

NER Range Pickers, [online], [retrieved on Aug. 7, 2009]. Retrieved from New England Range Service website. <URL: http://newenglandrange.com/Range.aspx>.

Range Servant, [online], [retrieved on Aug. 7, 2009]. Retrieved from Range Servant website. <URL: http://www.rangeservant.us/index.php>.

Hollrock—Division of Pareto Golf Inc., [online], [retrieved on Aug. 7, 2009]. Retrieved from Hollrock—Division of Pareto Golf Inc. website. <URL: http://www.hollrock.com/Pareto/EditModule.aspx?tabid=61&def=Pareto%20Product%20Detail&Itemid=501&mid=355>.

* cited by examiner

GOLF BALL PICKER BASKET AND METHOD

FIELD OF THE INVENTION

The present invention relates in general to a golf ball ranger range picker basket and a method of making it. It more particularly relates to a method and basket for receiving and storing golf balls, for use with a range picker at a golf ball driving range where the range picker is moved along the ground to retrieve golf balls from the ground and transports them to baskets carried on board the range picker.

BACKGROUND ART

There is no admission that the background art disclosed in this section legally constitutes prior art.

A driving range is a place golfers go to practice their golf shots and typically may include a substantially large parcel of land for the golfers to hit golf balls provided by the driving range operator. The driving range operator must retrieve golf balls hit by the golfers to make them available for reuse by other golfers. To collect the golf balls, range operators use a device called a golf ball range picker that carries usually a pair of metal, open frame wire baskets for receiving the golf balls as the range picker is typically pushed or pulled by a vehicle or manually by personnel, and retrieves the golf balls scattered on the ground and projects them into the baskets carried on board.

Such baskets used with golf ball range pickers for the collection, transportation, and storage of golf balls frequently found at golf driving ranges, have been typically manufactured from metal rods welded or otherwise suitably fixed together, to form a metal wire frame basket construction. Baskets so formed have been made of an open frame construction, wherein interconnected metal rod elements have been spaced from one another to form gaps or openings. The openings are sufficiently small in size to confine the golf balls within the basket. However, they are sufficiently large in size to permit the user to readily perceive the group of golf balls stored within the basket.

While such metal wire baskets have been satisfactory for some applications, they have been susceptible to being damaged by rust, since they are primarily used outdoors. In this regard, the baskets have been exposed to rain, snow, and other weather conditions. As the baskets are made of metal, the weather conditions tend to lead to the formation of rust. Eventually, excessive oxidation can destroy or otherwise render the basket unsuitable for its intended purpose. The integrity of the basket can deteriorate to the point where it becomes useless, and must then be replaced.

Another disadvantage of metal wire baskets is that should the welds be defective, the wire joints can be dislodged. As a result, the basket then looses the structural integrity, and may break apart. Such a basket must then be repaired or probably replaced.

Also, metal wire baskets carried on the golf ball range pickers were not supported securely on the range picker. The front points of support on the basket may be susceptible to bending and failing over time.

Mounting the baskets in a side by side arrangement securely on the range picker has created another problem. The closely spaced baskets would be difficult or awkward to lift manually out of the range picker basket support frame. This would be particularly troublesome when the baskets are heavily loaded with golf balls. When attempting to release the loaded baskets from the range picker basket support frame, a person could inadvertently spill some of the balls out of the basket. At the very least, such baskets would be awkward to lift from the range picker support frame, and thus not very convenient to use.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF CERTAIN EMBODIMENTS OF THE INVENTION

Figure 1:
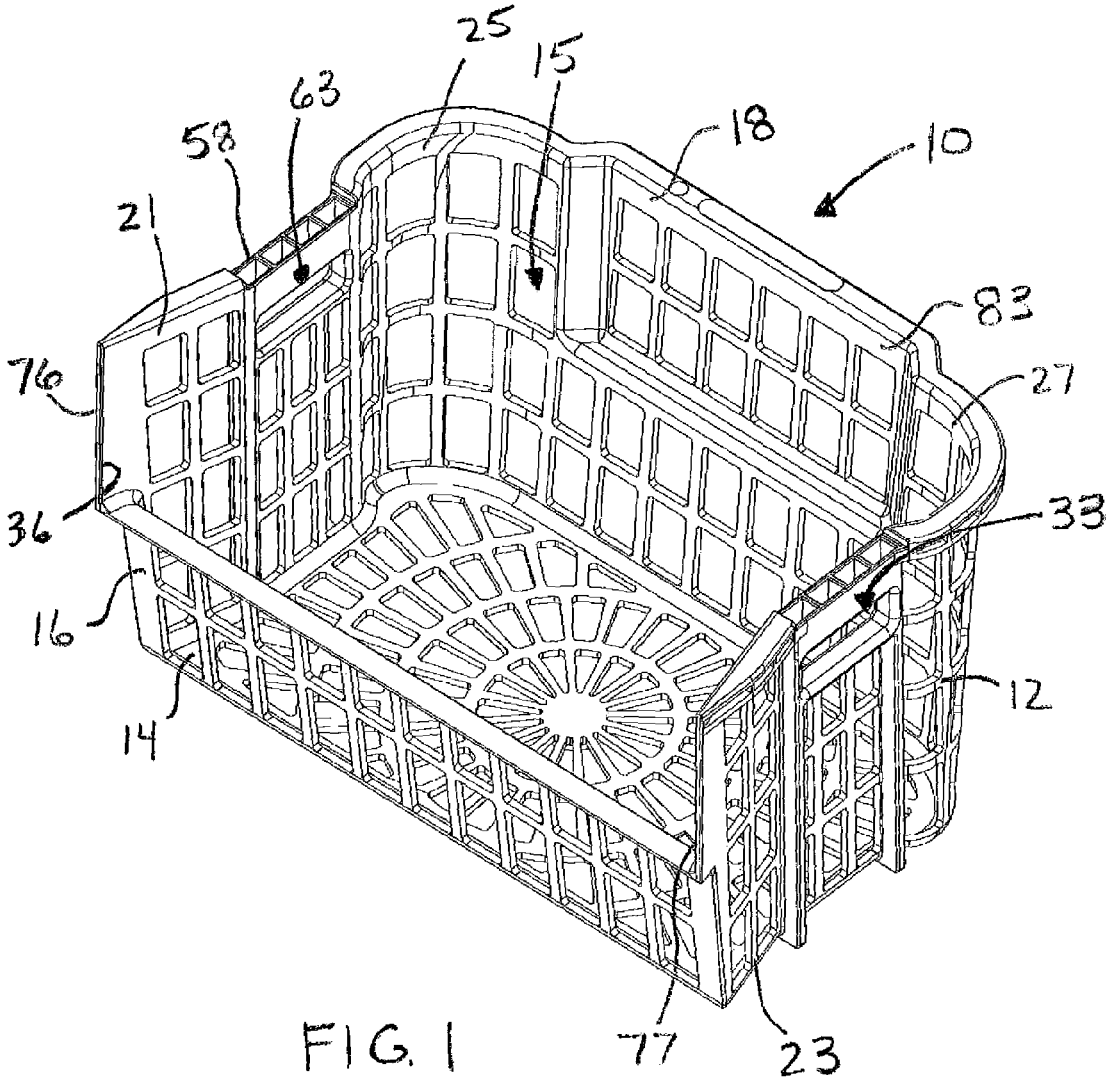
FIG. 1 is a front pictorial view of a plastic open frame basket constructed according to an embodiment of the invention.
Figure 2:
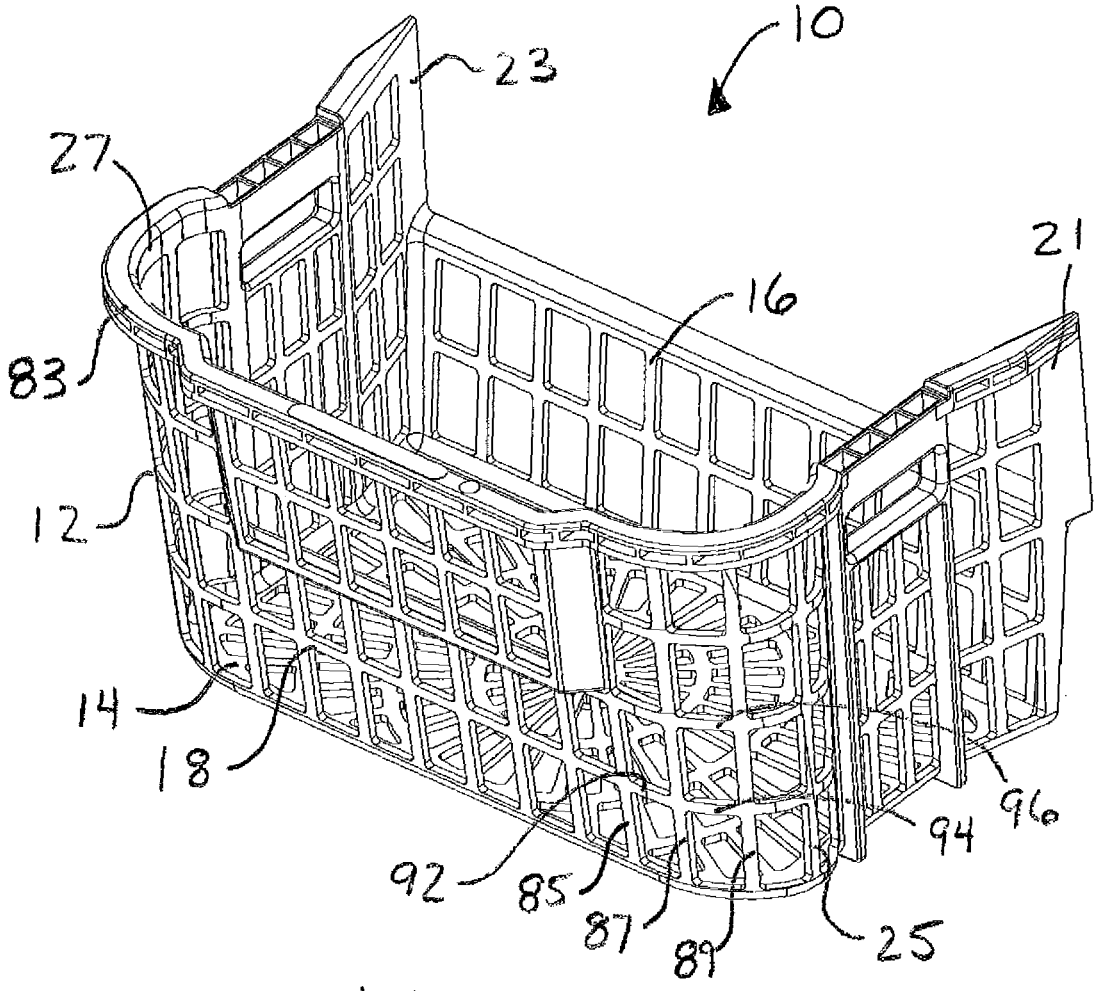
FIG. 2 is a front pictorial view of the plastic open frame basket of FIG. 1 constructed according to an embodiment of the invention.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

There is disclosed a method and a basket for use with a golf ball range picker having a support frame. The basket may include a pair of inwardly offset handles in the basket side walls for ease of lifting when a series of two or more like baskets are arranged in a closely spaced side by side configuration. A pair of front vertical edges of front side wall sections are each tapered outwardly toward the front to minimize or at least greatly reduce the surface area formed by abutting vertical edges of the pair of baskets, to help guide the golf balls being thrown by the range picker into the baskets, and not deflect them inadvertently away from entering the baskets by otherwise providing thick abutting vertical edges which could block the path of travel of the golf balls. A front flange is disposed substantially along the entire length of the front of the basket for resting securely on a front portion of the support frame, and a rear flange is adapted for resting securely on a back portion of the support frame.

In accordance with another embodiment of the present invention, there is provided a plastic open frame basket that may include a substantially rectangular in cross section vertical wall structure and a bottom wall integrally connected to the vertical wall structure. The vertical wall structure may include a front wall, a rear wall, and a pair of side walls. The front wall may include a bottom portion integrally connected to the bottom wall and the side walls. A rectangular opening is disposed above the front bottom portion for admitting the golf balls being thrown by the range picker into the basket. An elongated front flange defines substantially the entire length of the bottom of the opening, and is adapted to rest on top of a front portion of the range picker support frame. The rear wall may include an elongated rear flange adapted to rest on top of a rear portion of the range picker support frame to support the basket between the front and rear flanges. Each of the side walls may include an inwardly disposed offset handle section and an outwardly tapered forward section integrally connected to the front wall. Each of the handle sections may be disposed inwardly of the front tapered sections. Each outwardly tapered section may be adapted to mate with another outwardly tapered section of an adjacent like basket to form a narrow area of engagement to facilitate receiving the golf balls and not inadvertently deflecting them.

The plastic construction may provide a lighter weight basket that minimizes the total weight of the golf range picker, reduces the energy required during operation of the golf range picker, and reduces the handling weight of the baskets for the range personnel. The baskets of the present invention may be composed of suitable thermoplastic or thermoset material to enable the basket to be molded in a cost efficient manner, and yet be structurally strong. Presently, polypropylene material is preferred, but other suitable materials may also be employed.

A further embodiment of the invention relates to the method of making a plastic basket for a golf ball range picker. The method includes molding a one-piece generally rectangular open top basket, and includes the step of molding the side walls with a pair of inwardly off set handle sections each having finger grip openings. The method also includes molding a pair of outwardly tapered sections integrally connected to the handle sections. The method further includes molding elongated front and rear flanges for engaging respective front and rear portions of a range picker support bar.

Referring now to FIGS. 1, 2, and 4 through 9 of the drawings, there is shown a plastic open frame basket, which is constructed in accordance with an embodiment of the present invention and is generally indicated at 10. The basket 10 is preferably used with a golf ball range picker for collecting and transporting a quantity of golf balls (not shown). However, it will become apparent to those skilled in the art that the basket 10 may also be used for other applications, such as for collecting and transporting a quantity of food products such as fruits or vegetables, or for other applications.

The basket 10 has an open top and an open frame construction and has a one-piece construction. The basket 10 may be generally rectangular in horizontal cross section, but other shapes may be employed. The basket 10 includes vertical wall structure 12 and an inwardly dished convex base or bottom wall 14 to help rigidify and strengthen the basket 10, which form an interior space 15 for collection and storing golf balls. The vertical wall structure 12 may include a front wall 16, a rear wall 18, a pair of side walls 21, 23, and a pair of rounded rear corners 25, 27. The bottom wall 14 may include a generally cylindrical hollow spacer 17 for helping support the bottom wall 14 when the loaded basket rests on a supporting (not shown) and the convex or dished bottom wall sags downwardly under the weight of the golf balls (not shown) to engage the supporting surface for limiting further sagging. A peripheral edge 19 of the bottom wall has a radius to promote gliding along the ground and to resist catching on the ground and damage from off axis impacts.

Figure 3:
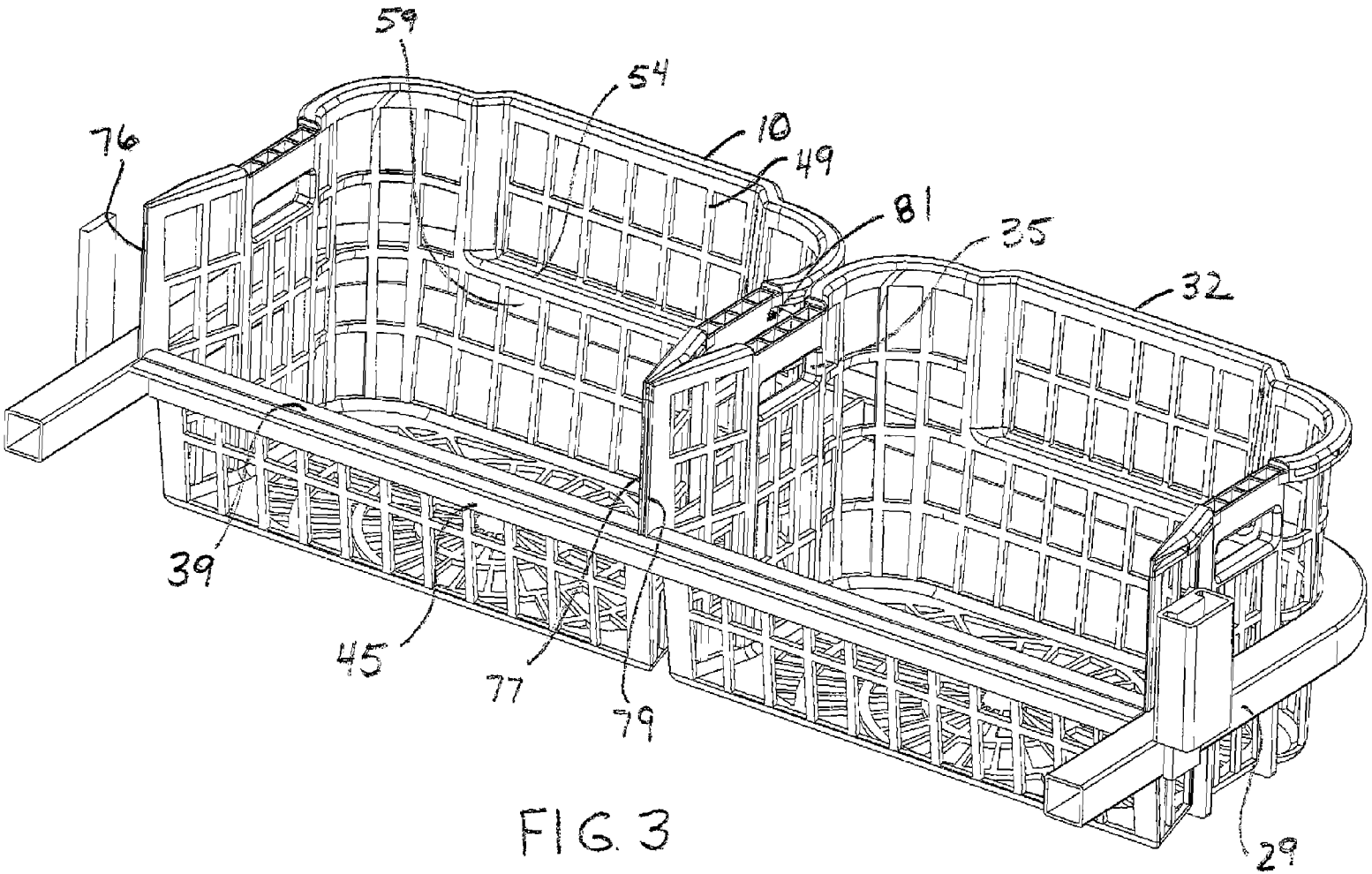
FIG. 3 is a pictorial view of a pair of the plastic open frame baskets of FIG. 1 supported by the range picker support frame.
Figure 4:
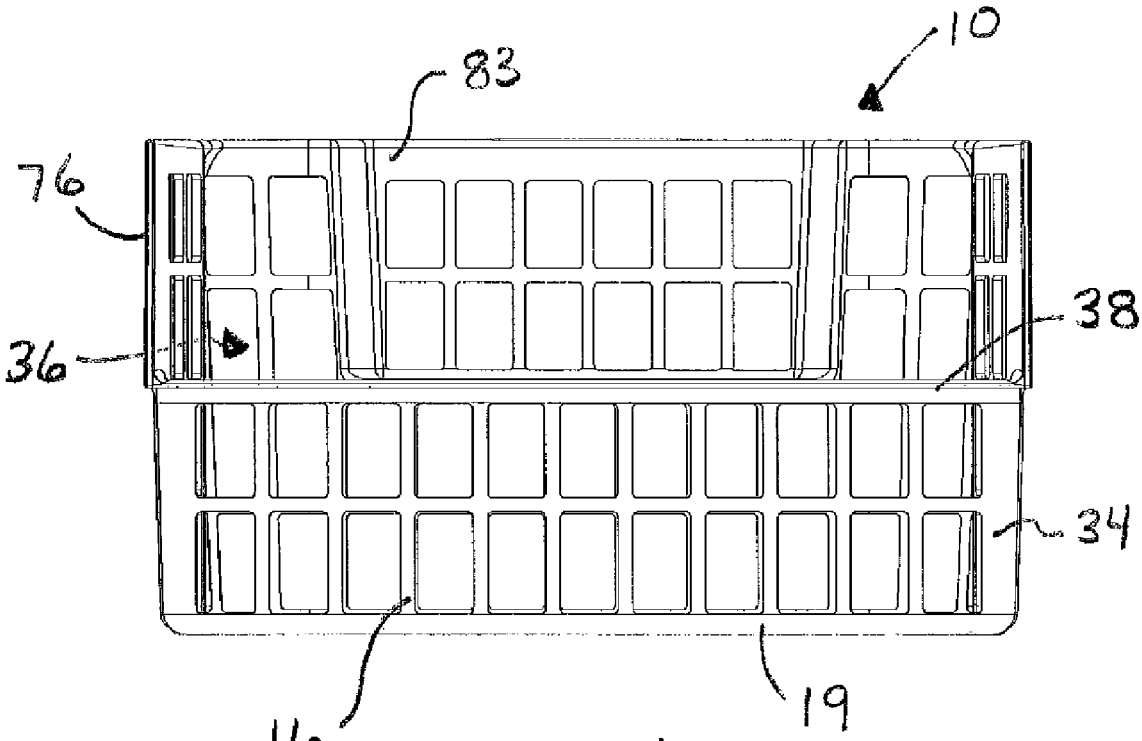
FIG. 4 is a front elevational view of the plastic open frame basket of FIG. 1.
Figure 5:
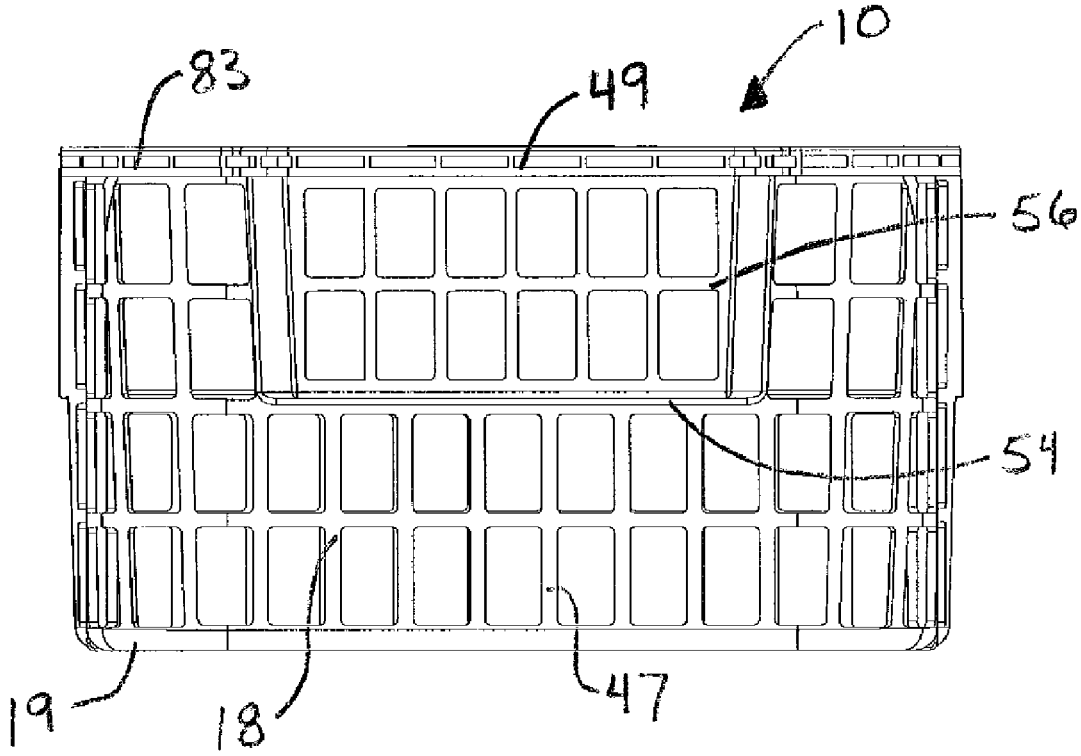
FIG. 5 is a rear elevational view of the plastic open frame basket of FIG. 1.
Figure 6:
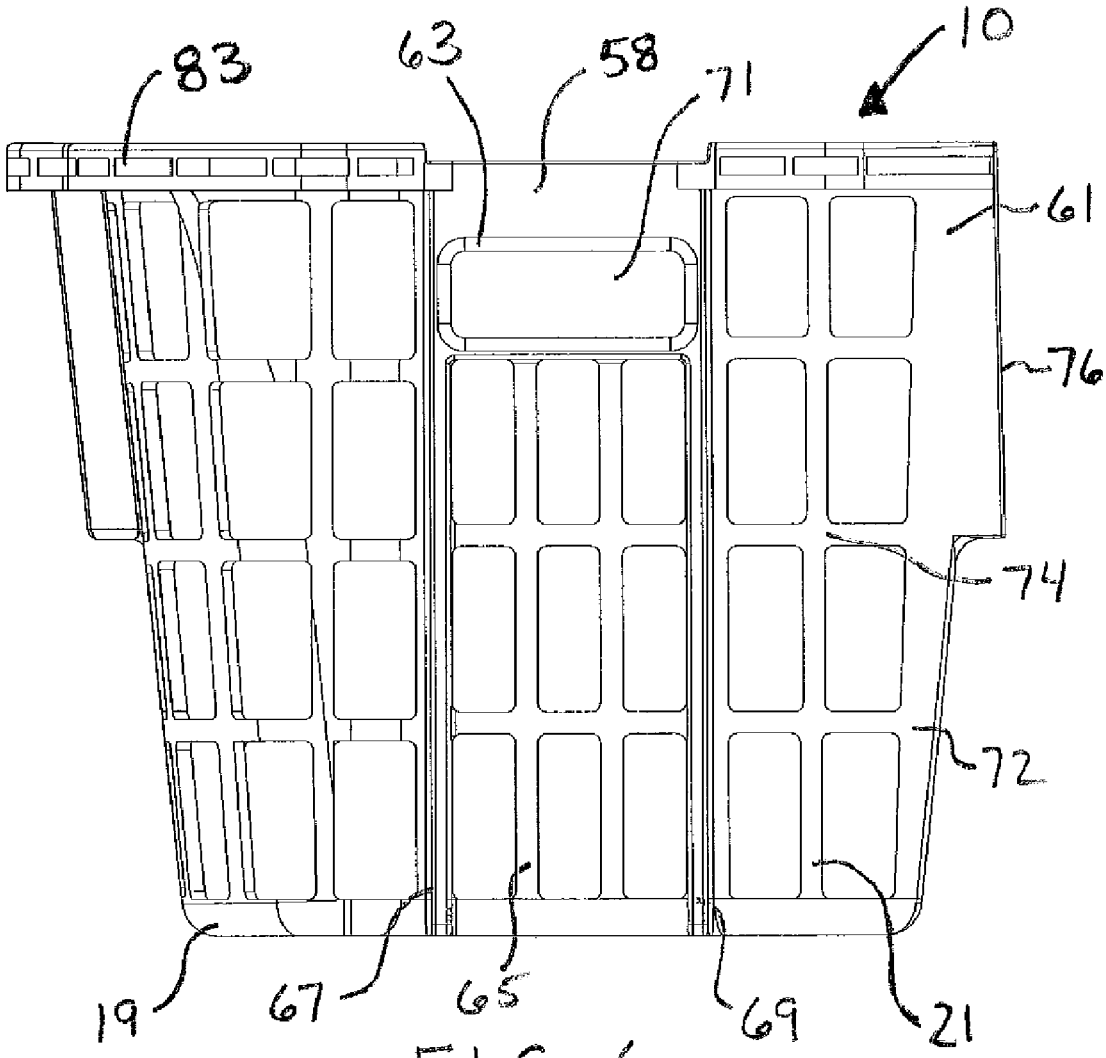
FIG. 6 is a side elevational view of the plastic open frame basket of FIG. 1.

As shown in FIG. 3, the basket 10 may be configured to rest in a golf ball range picker support frame 29 adjacent to a series on one or more like baskets such as a second like basket 32 to rest side by side as a pair. Each basket may include an upper finger grip handle such as handle 33 (FIG. 1) spaced from an upper handle 35 (FIG. 3) of the adjacent basket 32.

Figure 9:
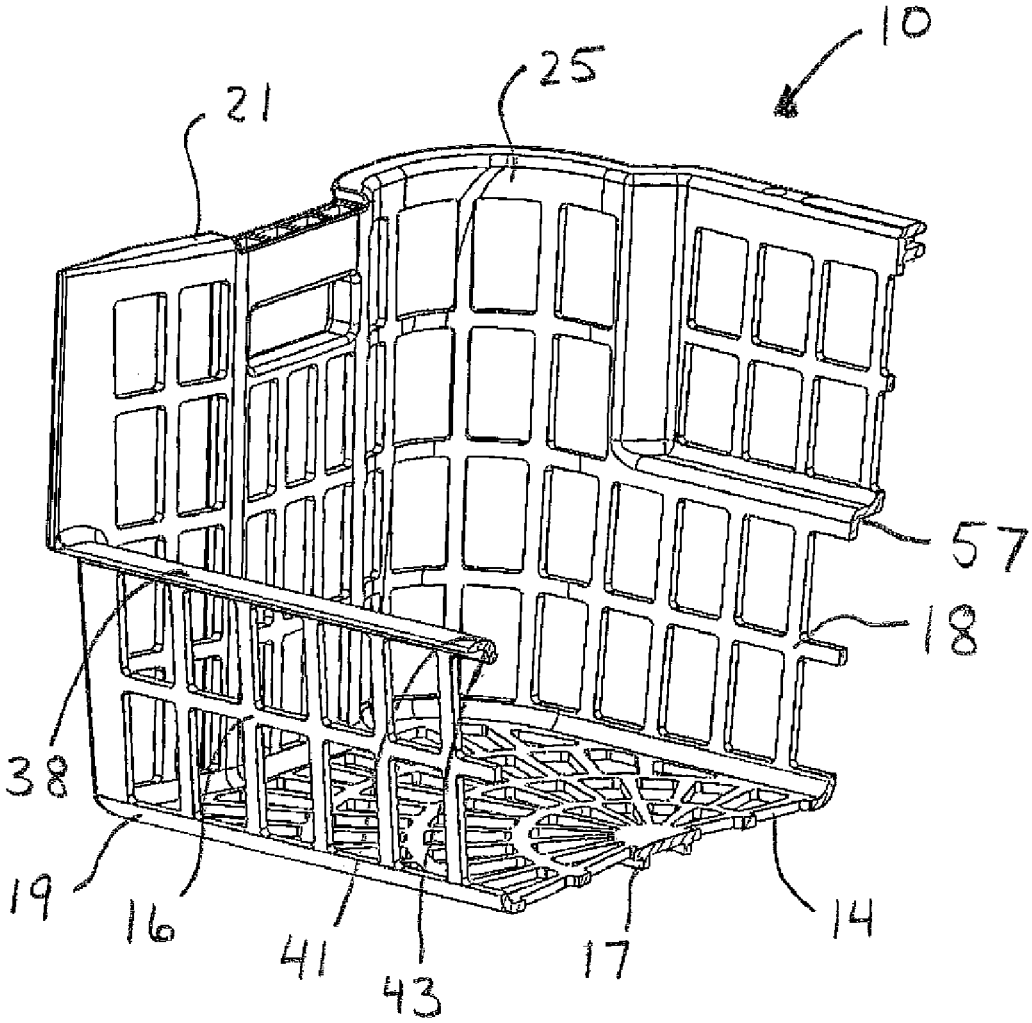
FIG. 9 is a sectional view of the plastic open frame basket of FIG. 1.

The front wall 16 may include a bottom portion 34 having an open frame construction, a rectangular opening 36 for admitting the golf balls into the basket 10, and an elongated front flange 38 defining substantially the entire length of the bottom of the opening 36. As best seen in FIGS. 3 and 9, the front flange 38 may include a convex-shaped upper surface portion 41 to provide a smoothly contoured non-blunt surface for the golf balls to glide over into the basket 10 and a concave-shaped lower portion 43 to improve the durability and strength of the flange 38 for receiving the range picker support frame 29 along a continuous line of engagement therewith. The front flange 38 may overlie a substantial portion of a front crossbeam 45 of the range picker support frame 29 as shown in FIG. 3.

The rear wall 18 may include a bottom portion 47 having an open frame construction and a outwardly projecting rear flange section 49 for resting on a portion of a rear crossbeam 52 of the range picker support frame 29 (FIG. 3). The rear flange section 49 may be U-shaped in horizontal cross section and include a solid base portion 54 and a U-shaped vertical wall portion 56 having a generally open frame construction. The solid base portion 54 may include a radius 57 to improve durability of the flange section 49.

The side walls 21 and 23 may be substantially mirror-images of one another, and therefore only the right side wall 21 will be described in greater detail. The right side wall 21 may include an inwardly disposed offset handle section 58 and an outwardly tapered section 61, both of which having substantially an open frame construction.

Figure 10:
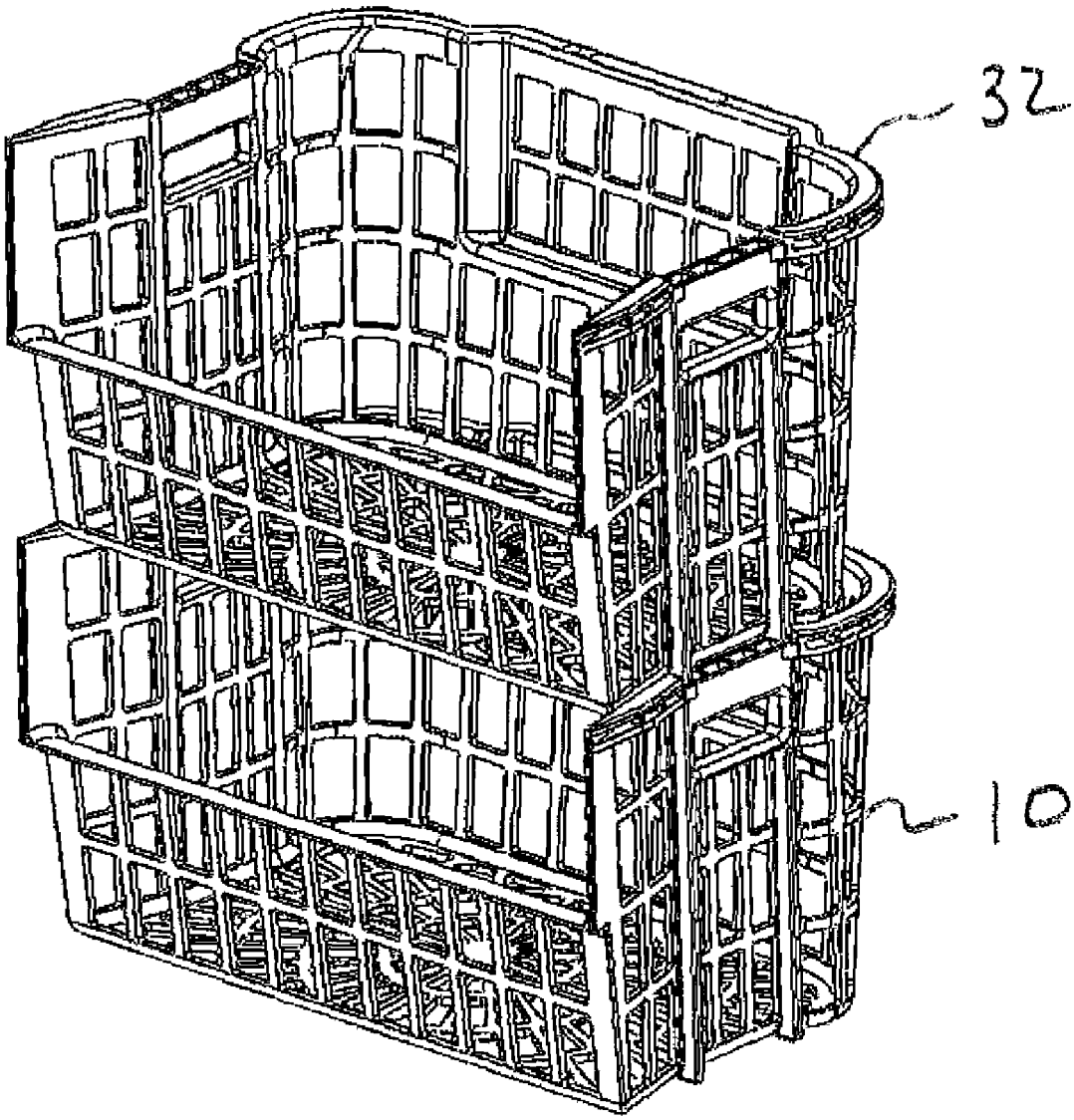
FIG. 10 is a pictorial view of a pair of the plastic open frame baskets of FIG. 1 with one basket stacked on top of the other basket.
Figure 11:
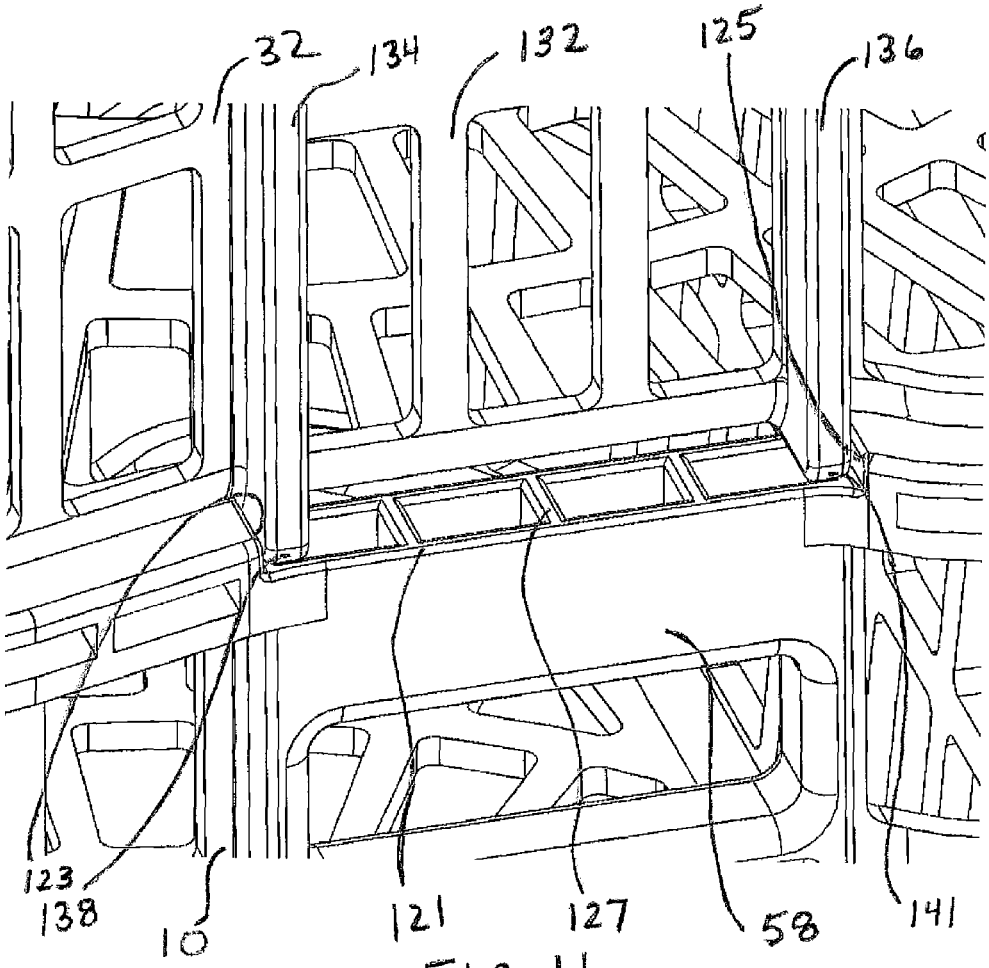
FIG. 11 is an enlarged view of the interlocking portion of the stacked baskets of FIG. 10.

The handle section 58 of the side wall 21 may include an upper handle 63 for lifting the basket 10, a lower open frame portion 65 directly below the upper handle 63, and a pair of rib members 67, 69 disposed substantially along the entire length of each edge of the handle section 58 to strengthen the side wall 21 and allow the stacking of a like basket 32 on top of the basket 10 as shown in FIG. 10 by having the bottom ends of the ribs rest on and snugly engage the top surface of the handle section of the like basket. As shown in FIG. 11, the handle section 58 of the basket 10 may include a recessed area 121 having a pair of ends 123, 125 and a base 127. The basket 32 may be stacked on top of basket 10 by interlocking the ribs 134, 136 of the handle section 132 of the basket 32 with the recessed area 121 of the basket 10, such that the ends 138, 141 of the ribs 134, 136 rest on the base 127 and adjacent to the ends 123, 125, respectively. The upper handle 63 may include a finger grip opening 71 for gripping the basket 10 for lifting and/or transporting.

The tapered section 61 of the side wall 21 may include a lower portion 72 integrally connected to the bottom portion 34 of the front wall 16 and an upper portion 74 having a front vertical edge 76 adjacent to the opening 36. The tapered section 61 may be angled outwardly from the handle section 58 to help deflect golf balls into the basket 10. The front tapered edges such as the right edge 76 and the left tapered edge 77 of the adjacent basket 31 (FIG. 3) are designed to mate when disposed side by side to minimize or greatly reduce the front surface area when the two baskets are arranged side by side as shown in FIG. 3.

The rear rounded corners 25 and 27 may also be substantially mirror-images of one another, and therefore only the right corner 25 may be described in greater detail. The right corner 25 may have an open frame construction and integrally join the right side wall 21 with the rear wall 18. The right corner 25 may have a radius that in cooperation with the tapered section 61 help provide for the inward offset of the handle section 58. As shown in FIG. 3, when two baskets are arranged in a side by side manner, the adjacent corners and tapered sections may be in contact allowing an opening 81 between the two offset handle sections of sufficient size to allow the convenient insertion of a user's fingers therebetween to access the handle portions even if both baskets are full of golf balls. This arrangement facilitates greatly the manual lifting of the basket from the support frame with little or no disruption of an adjacent basket.

The height of the rear wall 18, the side walls 21, 23, and the corners 25, 27 of the vertical wall structure 12 may all be substantially the same, while the height of the front wall may be substantially one-half the height of the other walls and rear corners. A reinforced rib section 83 may be disposed along the top of the rear wall 18, the side walls 21, 23, and the corners 25, 27 of the vertical wall structure 12 for added strength to minimize deflection when the basket 10 is lifted or carried.

The open frame construction of the vertical wall structure 12 may include a plurality of rectilinear, smoothly contoured longitudinal rib members, such as longitudinal rib members 85, 87, and 89, which are integrally connected between the bottom wall 14 and the rim section 83, and a plurality of cross rib members, such as cross rib members 92, 94, and 96, which are integrally connected between adjacent longitudinal rib members, such as longitudinal rib members 85 and 87, and 87 and 89.

Figure 7:
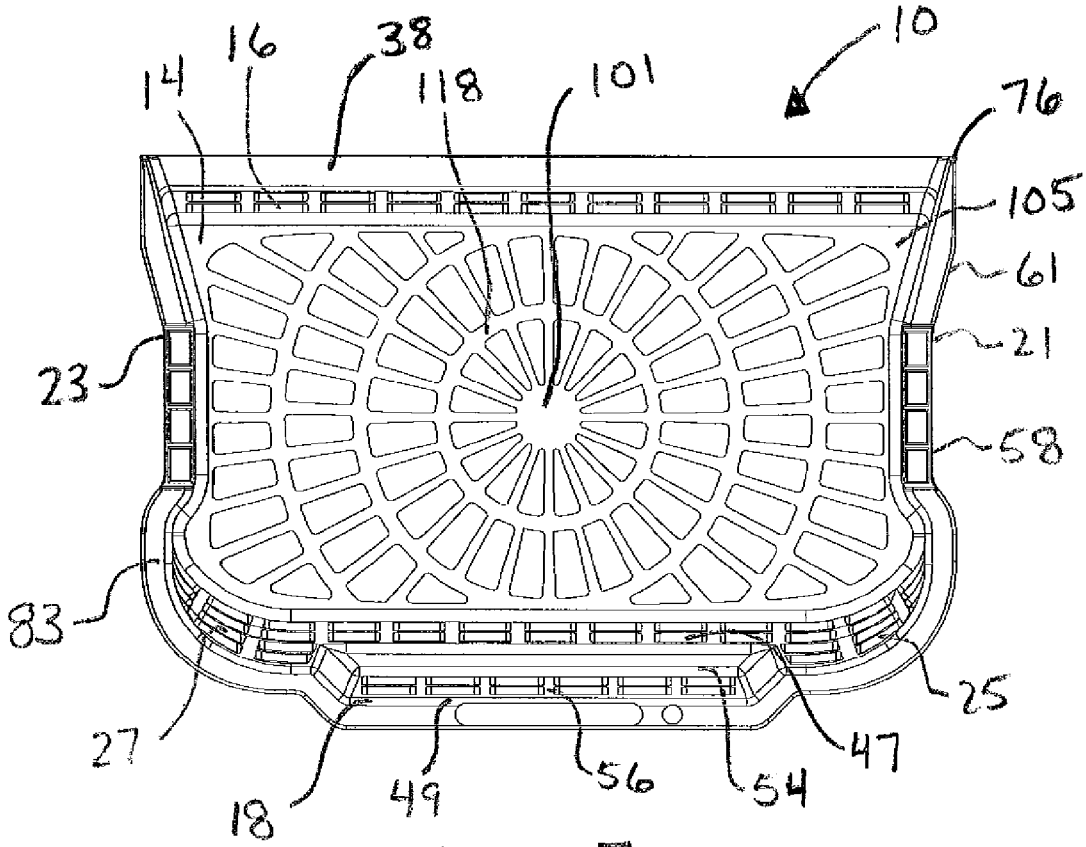
FIG. 7 is a top view of the plastic open frame basket of FIG. 1.
Figure 8:
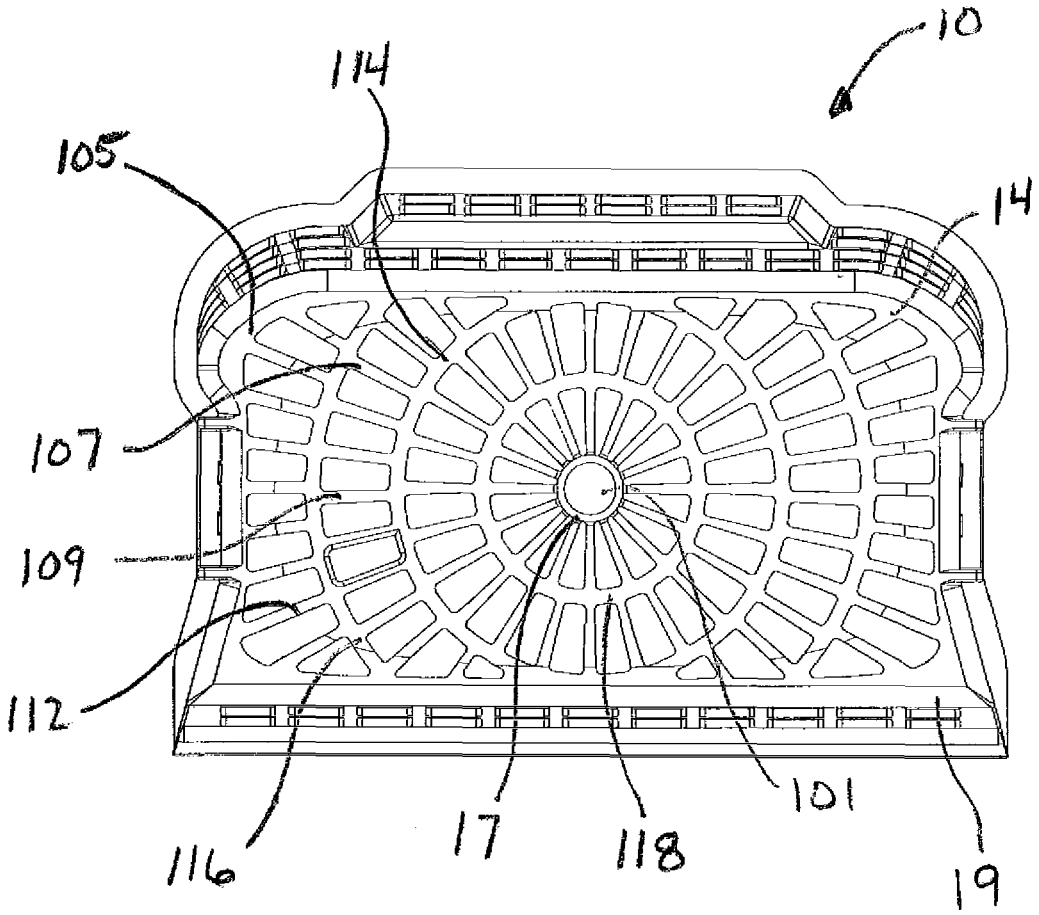
FIG. 8 is a bottom view of the plastic open frame basket of FIG. 1.

As best seen in FIGS. 7 and 8, the inwardly dished base or bottomwall 14 may have an open frame construction. The base wall 14 may include a central hub member 101, an outer edge portion 105, and a plurality of radiating spoke members, such as spoke members 107, 109, and 112 disposed therebetween. A plurality of curved base cross members, such as base cross members 114 and 116, may be disposed between adjacent spoke members 107 and 109, and spoke members 109 and 112, may be aligned to define a full or partial concentric base rings, such as concentric base ring 118. The spacer 17 may be centrally disposed on the central hub 101, and depend therefrom by a suitable distance spaced from the outer periphery of the bottom wall 14.

It is to be understood that the dimensions of the baskets may be altered to conform to size and configuration of the range picker or other appropriate device.

While particular embodiments of the present invention have been disclosed, it is to be understood that various different modifications are passing and one contemplated within the true spirit and scope of the appended claims. There is no intention, therefore, of limitations to the exact abstract or disclosure herein presented.

What is claimed is:

1. A basket for use with a golf ball range picker having a support frame, comprising:

a substantially rectangular wall structure defining a vertical wall structure including a front wall, a rear wall, and a pair of side walls;

a bottom wall integrally connected to the vertical wall structure;

the front wall including a bottom portion integrally connected to the bottom wall and the side walls, a rectangular opening disposed above the bottom portion for admitting the golf balls to the basket, and an elongated front flange defining substantially the entire length of a bottom of the opening and for resting on top of a front portion of the range picker support frame;

the front flange having a rounded convex-shaped smoothly contoured non-blunt upper surface portion for the golf balls to glide over into the basket and a rounded concave shaped lower portion extending unrestrictedly for receiving the picker support frame along a continuous line of engagement therewith;

the rear wall including a rear flange portion at about the same height above the bottom wall as the front flange for resting on top of a rear portion of the range picker support frame to support the basket between the front and rear flanges;

the rear flange projecting rearwardly from a portion of the rear wall and being a bottom portion of a rearwardly projecting rear flange section being U-shaped in horizontal cross section with a solid base portion and a U-shaped vertical open-frame wall;

each of the side walls including an inwardly disposed offset an open-frame handle section and an outwardly angled tapered section integrally connected to the front wall;

wherein the basket includes a plurality of rectilinear and cross rib members to form in a one-piece open-frame construction composed entirely of plastic material and including openings, the openings in the open-frame construction being sized to confine golf balls within the basket;

wherein each of the handle sections are disposed inwardly of the outermost outwardly angled tapered sections to provide space for a fingers of a user to grasp the handle sections to lift the basket from the picker support frame when a like basket is disposed adjacent thereto;

wherein each of the outwardly angled tapered section diverge outwardly in horizontal section from the open frame handle sections to the rectangular opening and terminate in a front vertical edge tapered in horizontal section to mate with another tapered edge of an tapered front vertical edge of another outwardly angled tapered section of a like basket disposed adjacent thereto to form a narrow area of engagement to facilitate receiving the golf balls; and a pair of rounded corners sections in the horizontal section, each of the corner sections joining integrally the rear wall and one of the side walls and including the plurality of rectilinear and cross rib members to form the one-piece open-frame construction.

2. The basket according to claim 1, wherein the bottom wall is convex to provide strength and durability to the basket.

3. The basket according to claim 1, wherein the bottom wall is convex and includes a downwardly depending spacer for supporting the bottom wall when the basket is on a substantially flat surface.

4. The basket according to claim 1, wherein the tapered front vertical edge adjacent to the rectangular opening of each of the outwardly tapered sections is for mating with a tapered front vertical edge of the like basket to form the narrow area to deflect golf balls into the basket.

5. The basket according to claim 1, further including a reinforced rib section disposed at the top of the rear and side walls.

6. The basket according to claim 1, wherein the front flange includes a concave-shaped lower portion to improve durability.

7. The basket according to claim 1, wherein the front flange includes a convex-shaped upper portion to create the non-blunt surface for the golf balls to glide over.

8. The basket according to claim 1, wherein the handle section includes a pair of vertical ribs allowing like baskets to be stacked on top of one another.

9. The basket according to claim 1, wherein the rear flange portion includes a convex-shape lower portion to improve durability.

10. The basket according to claim 1, wherein the bottom wall includes a base edge having a radius to promote gliding along the ground and to resist catching on the ground and damage from off axis impacts.

11. The basket according to claim 1, wherein a front vertical edge adjacent to the rectangular opening of each of the outwardly tapered sections is for mating with a front vertical edge of the like basket to form the narrow area to deflect golf balls into the basket.

12. The basket according to claim 1, further including a reinforced rib section disposed at the top of the rear and side walls.

13. The basket according to claim 1, wherein the handle section includes a pair of vertical ribs allowing like baskets to be stacked on top of one another.

14. The basket according to claim 1, wherein the bottom wall includes a base edge having a radius to promote gliding along the ground and to resist catching on the ground and damage from off axis impacts.

* * * * *